United States Patent [19]

Oswald et al.

[11] Patent Number: 4,462,143

[45] Date of Patent: Jul. 31, 1984

[54] METHOD FOR CONTROLLING TEXTURE LEVEL IN A MOVING CAVITY TEXTURING PROCESS

[75] Inventors: Hendrikus J. Oswald, Morristown; Hsin L. Li, Parsippany; Russell H. Butler, Rockaway, all of N.J.

[73] Assignee: Allied Corporation, Morris Township, Morris County, N.J.

[21] Appl. No.: 357,396

[22] Filed: Mar. 12, 1982

[51] Int. Cl.[3] ..... D02G 1/12; D02G 1/16

[52] U.S. Cl. ..... 28/257; 28/250; 28/251

[58] Field of Search ..... 28/256, 257, 263, 248, 28/250, 251; 73/37.7; 68/5 E

[56] References Cited

U.S. PATENT DOCUMENTS

| | | | |
|---|---|---|---|
| 3,037,260 | 6/1962 | Pike, Jr. | 28/250 |
| 3,200,467 | 8/1965 | Iwnicki et al. | 28/250 |
| 3,296,680 | 1/1967 | Iwnicki et al. | 28/250 |
| 3,406,436 | 10/1968 | Clarke, Jr. | 28/250 |
| 3,859,695 | 1/1975 | Erickson | 28/250 |
| 3,887,972 | 6/1975 | Bauch | 28/257 |
| 4,074,405 | 2/1978 | Li et al. | 28/257 |
| 4,075,739 | 2/1978 | Staheli | 73/37.7 |
| 4,162,564 | 7/1979 | Stanley | 28/250 X |
| 4,302,968 | 12/1981 | Moser | 28/250 X |
| 4,306,450 | 12/1981 | Moser | 28/250 X |

FOREIGN PATENT DOCUMENTS

| | | | |
|---|---|---|---|
| 141761 | 5/1980 | German Democratic Rep. | 28/257 |
| 49104 | 1/1974 | Japan | 28/250 |
| 1161674 | 8/1969 | United Kingdom | 28/250 |

*Primary Examiner*—Robert Mackey

*Attorney, Agent, or Firm*—James Riesenfeld; Gerhard H. Fuchs; Michael J. Weins

[57] ABSTRACT

A method an is described for monitoring and controlling the texture level of a yarn produced in a moving cavity texturing apparatus. The texture level of the yarn is controlled by monitoring fluid pressure in the cavity. The pressure is used as a feedback signal for control of the texture level of the yarn.

2 Claims, 6 Drawing Figures

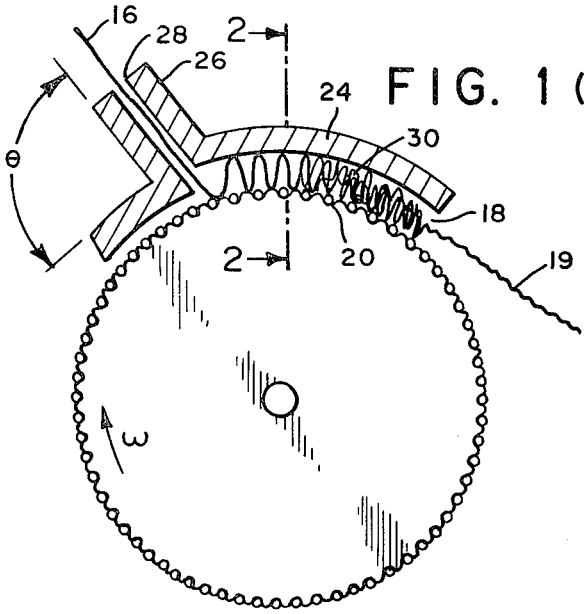
FIG. 1 (PRIOR ART)
FIG. 2 (PRIOR ART)
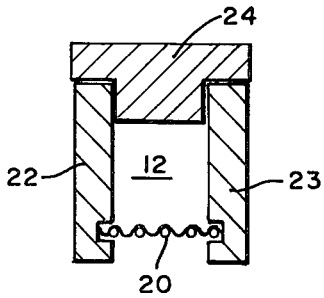
FIG. 3
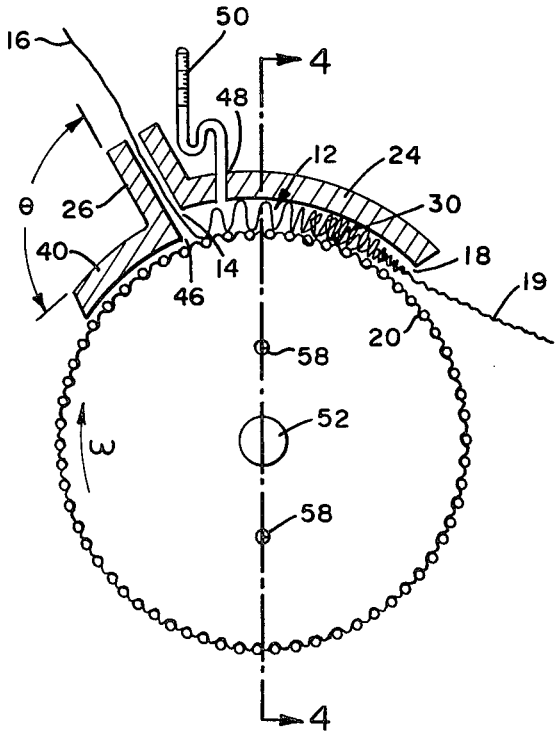
FIG. 4
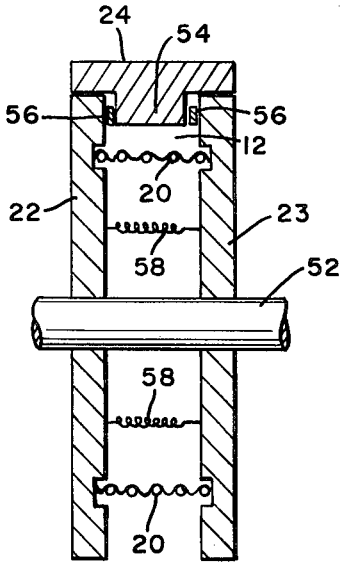

METHOD FOR CONTROLLING TEXTURE LEVEL IN A MOVING CAVITY TEXTURING PROCESS

DESCRIPTION

Field of Invention

The present invention relates to a method for controlling the texture level of yarn produced by a moving cavity texturing apparatus.

BACKGROUND OF INVENTION

Methods for control of the texture level of yarn produced by moving cavity texturing apparatuses are based on the principle of constant volume displacement per unit time. For a predetermined yarn speed, as measuring at the inlet to the moving cavity texturing apparatus, changes in the position of the end of a plug formed in the moving cavity are monitored and used to generate a feedback signal. The feedback signal can then either cause a change in a fluid pressure or temperature or a change in the speed of the moving cavity. Increasing or decreasing the fluid pressure or temperature causes a corresponding increase or decrease in the packing density of the plug and thus increases or decreases the mass flow per unit time for a given volume displacement. Increasing or decreasing the packing density of the plug produces a correspondingly higher or lower texture level.

The plug contains many yards of yarn, which results in a considerable time lag between the time when the yarn passes the location where texturing is occurring, and the time when the yarn reaches the end of the plug where monitoring takes place. The result is that the yarn, although it may have a uniform overall average texture, has local variations between short, adjacent yarn segments. These local variations will show up as machine barré in knitted fabrics.

The texture level of the yarn produced by the moving cavity texturing process disclosed in U.S. Pat. No. 4,074,405 is controlled by monitoring the position of the end of the plug. This procedure suffers from the time lag between the time of monitoring and the time of texturing, as discussed above.

SUMMARY OF INVENTION

The method of the present invention is applicable to moving cavity apparatuses of the type described in U.S. Pat. No. 4,074,405. In general, these aparatuses have a cavity with an inlet for receiving the yarn and a heated fluid employed to advance the yarn into the cavity. A porous yarn-receiving means forms one wall of the cavity. The porous yarn-receiving means imparts crimps into the yarn, and serves to reduce the pressure in the cavity by allowing partial removal of the heated fluid. The sides of the cavity are formed by two spaced apart sidewalls. A stationary shoe mates with the two spaced apart sidewalls. The spaced apart sidewalls advance with the porous yarn-receiving means. The cavity has an outlet for removal of a yarn plug that forms within the cavity.

The moving cavity apparatus used in the practice of the present invention has, in addition to the above features, the following improvements. A stationary shoe extension extends from, the inlet to the cavity, to the porous yarn-receiving means. The stationary shoe extension seals the cavity and forms a first closed end. The cavity is closed at the second end by the yarn plug. Means for sealing mating surfaces formed between the two sidewalls and the stationary shoe are provided. A pressure tap is provided to allow sensing of the pressure in the cavity.

The method of the present invention consists of monitoring the pressure in the cavity via the pressure tap, and then adjusting the temperature, pressure or cavity velocity in response to the pressure reading. Using this method a uniform textured yarn can be produced.

BRIEF DESCRIPTION OF THE DRAWINGS

FIG. 1 is an illustration of a prior art apparatus for texturing yarn.

FIG. 2 is a section of the apparatus shown in FIG. 1 taken along the line 2—2 of FIG. 1.

FIG. 3 is a schematic representation of an improved apparatus suitable for practicing the present invention.

FIG. 4 is a section of the improved apparatus of FIG. 3 taken along the line 4—4 of FIG. 3.

BEST MODES OF CARRYING THE INVENTION INTO PRACTICE

Figure 5:
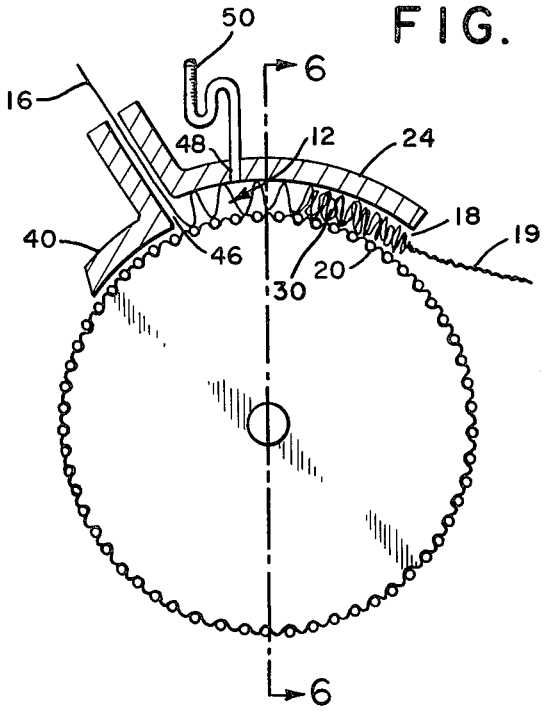
FIG. 5 is a schematic representation of another improved apparatus suitable for practicing the present invention.

FIG. 1 is a schematic representation of the prior art single chamber moving cavity texturing apparatus described in U.S. Pat. No. 4,074,405. The apparatus has a chamber 12 including an inlet opening 14 for receiving a yarn 16 to be crimped, and an outlet opening 18 for withdrawl of the crimped yarn 19 therefrom. The yarn 16 is crimped by the moving porous yarn receiving means 20. The porous yarn-receiving means 20 forms a boundary of the chamber 12. FIG. 2 shows the section 2—2 of FIG. 1. The porous yarn-receiving means 20 is held in place by spaced apart sidewalls 22,23. The sidewalls 22, 23 form two bounds of the chamber 12. The chamber 12 is completed by a shoe 24. The spaced apart sidewalls 22, 23 and the porous yarn-receiving means 20 move as an integral unit, while the shoe 24 remains stationary.

The yarn 16 is fed into an energy tube 26 by a heated compressed fluid which enters through the opening 28. The heated compressed fluid brings the yarns 16 into contact with the porous yarn-receiving means 20, the yarn-receiving means deflects the yarn 16 and sets an incipient crimp in the yarns 16. The yarn-receiving means 20 is porous, and allows for partial removal of the compressed fluid. The yarn 16 is advanced in the chamber 12 by the moving porous yarn-receiving means 20 and by the heated fluid. Secondary crimps are introduced as the yarn advances in the chamber 12 forming a plug 30 in the vicinity of the outlet 18. The plug of crimped yarn 30 is advanced by the moving porous yarn-receiving means 20. The crimped yarn 19 is then withdrawn from the plug 30 through the outlet 18 of the chamber 12.

In order to practice the present invention, the prior art moving cavity texturing apparatus, described above, must be modified. FIG. 3 is a schematic representation of a modified prior art moving cavity texturing apparatus suitable for practicing the present invention. The shoe 24 has a shoe extension 40 which extends the shoe 24 beyond the inlet opening 14. The shoe extension 40 extends down to, but preferably does not make contact with, the porous yarn-receiving means 20. Preferably, the separation between the shoe extension 40 and the yarn-receiving means 20 is maintained between about 0.002 inch (0.005 cm) and 0.010 inch (0.025 cm). The shoe extension 40 forms the first closed end 46 of the chamber 12. A tap hole 48 passes through the shoe 24 for monitoring the static pressure in the chamber 12. The tap hole 48 is preferably located at a distance between 0.06 inch (0.15 cm) and 0.25 inch (0.635 cm) from the inlet opening 14 of the chamber 12. The pressure in the chamber 12 is sensed by a pressure sensing gage 50.

FIG. 4 shows the section 4—4 of FIG. 3, and illustrates one sealing means employed between the shoe 24 and the spaced apart sidewalls 22, 23; and the shoe extension 40 and the spaced apart sidewalls 22, 23.

The sidewalls 22, 23 are slidably mounted on a shaft 52. The shoe 24 has a tongue 54 which extends into the chamber 12. Shims 56, of shim stock such as brass, provide a sliding seal between the tongue 54 and the spaced apart sidewalls 22, 23. The seal is maintained between the tongue 54 and spaced apart sidewalls 22, 23 by a tension means such as a tension spring 58.

FIG. 5 is a schematic representation of another improved apparatus suitable for the practicing the present invention. Again the shoe 24 is provided with a shoe extension 40 which closes the first end 46 of the chamber 12. A tap hole 48 is again used to monitor the pressure in the chamber 12.

Figure 6:
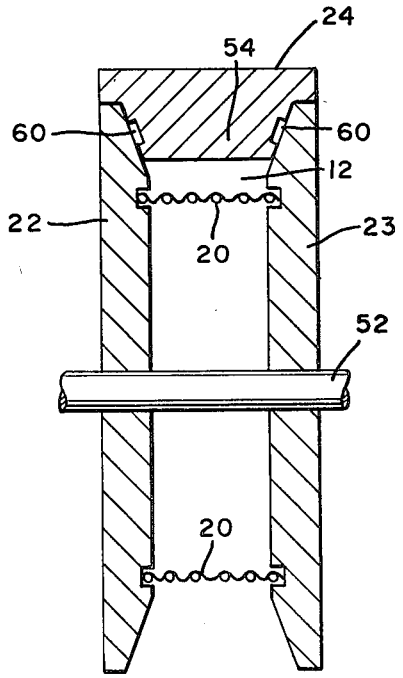
FIG. 6 is a section of the apparatus of FIG. 5 taken along the line 6—6 of FIG. 5.

FIG. 6 is a cross section 6—6 of FIG. 5. As can be seen, the spaced apart sidewalls 22, 23 of the chamber 12 diverge as the spaced apart sidewalls 22, 23 move away from the porous yarn-receiving means 20. The shoe 24 is provided with a tongue 54 which mates with the divergent sidewalls 22, 23 and forms a seal between the shoe 24 and the sidewalls 22, 23. It is preferred that there be recesses 60 to minimize the sliding contact between the spaced apart sidewalls 22, 23 and the mating surfaces of the tongue 54. These recesses 60 may be either in the tongue 54 as illustrated, or alternatively in the spaced apart sidewalls 22, 23.

When the static pressure in the chamber 12 increases, a servo, not shown, is activated to reduce either the pressure of the heated fluid, the temperature of the heated fluid and/or the speed of the moving cavity. When the pressure in the chamber 12 decreases, the servo is activated to increase the pressure of the fluid, the temperature of the fluid, and/or the speed of the moving cavity. In this way, the fluctuation in the chamber pressure can be controlled to minimize fluctuations of the texture of the resulting yarn.

EXAMPLE

Polyethylene terephthalate yarn of a nominal 150 denier, 34 filament was textured using apparatus similar to that illustrated in FIG. 3 and FIG. 4. The hot fluid was superheated steam which was injected into the energy tube 26 from a nozzle not shown. The nozzle had a diameter of 0.034 inches (0.09 cm), and the steam supplied to the nozzle was at 240° C. and 100 psi (800 kPa) The yarn was preheated to about 110° C., in a preheater not shown, before it was fed into the energy tube 26 where it was aspirated. The energy tube 26 had a diameter of 0.062 inches (0.16 cm). The inclination of the energy tube $\theta$ was 60° with respect to the porous yarn-receiving means 20, which was a 90 mesh screen. The yarn 16 was fed into the cavity 12 at a rate of 450 mpm. The cavity had a width of 0.070 inches (0.18 cm), and a depth of 0.050 inches (0.127 cm). The pressure tap for the chamber 12 was between the inlet 14 and the outlet 18 and located 0.065 inches (0.165 cm) from the inlet 14. The pressure tap had a bore of 0.010 inches (0.025 cm).

When the channel 12 was operated under the above conditions it was found that as time progressed, the channel pressure fluctuated (oscillated). The channel pressure reading on the monimeter was originally 0.76 cm of mercury (Hg), at a later time it had drifted to a maximum of about 4.4 cm of Hg, the pressure then decreased past the original value down to 0.11 cm of Hg, then increased again. These fluctuations are caused by either minor variations in feeder yarn quality and/or temperature or moisture content in the steam. The plug produced at the control reading of 0.7 cm Hg had a packing density of 34% which corresponds to a skein shrinkage of 38%. At the higher and lower channel pressures of 4.4 and 0.11 cm of Hg, the packing density of the plug increased to 42%, and decreased to 27% respectively; corresponding skein shrinkage values are 41% and 36%, respectively. Obviously these variations in skein shrinkage are unacceptable since they lead to barré in the dyed fabric.

What we claim is:

1. A method for monitoring the texture level of a yarn during texturing in a moving cavity texturing apparatus, the cavity having an inlet opening for receiving the yarn and a hot fluid to advance the yarn, a porous yarn-receiving means forming one wall of the cavity which provides for partial removal of the hot fluid serving to reduce the pressure in the cavity, a stationary shoe provided with a tongue which is positioned between and which mates with spaced apart moving sidewalls which advance with the porous yarn-receiving means, a shoe extension for closing a first end of the cavity, an outlet for removal of a yarn plug formed, the yarn plug closing a second end of the cavity therein, comprising:

maintaining a seal between the tongue of the stationary shoe and the spaced apart moving sidewalls, the monitoring the pressure in the moving cavity.

2. The method of claim 1 wherein the pressure is monitored between the inlet opening, and the plug at a distance from the inlet opening of between about 0.06 inch (0.15 cm) and 0.25 inch (0.635 cm).

* * * * *

UNITED STATES PATENT AND TRADEMARK OFFICE

CERTIFICATE OF CORRECTION

PATENT NO. : 4,462,143

DATED : July 31, 1984

INVENTOR(S) : H. J. Oswald, et al.

It is certified that error appears in the above-identified patent and that said Letters Patent are hereby corrected as shown below:

Abstract, Line 1 - delete "an"

Column 3, Line 1 - ...shoe extension 40 should read --shoe extension 40,

Column 4, Line 51 - delete "the" and insert "and"

Signed and Sealed this

Twelfth Day of February 1985

[SEAL]

*Attest:*

DONALD J. QUIGG

*Attesting Officer*

*Acting Commissioner of Patents and Trademarks*